US005127556A

United States Patent [19]

Sporri

[11] Patent Number: 5,127,556

[45] Date of Patent: Jul. 7, 1992

[54] LOW MASS PISTON SYSTEM FOR NECKED-IN AEROSOL CANS

[75] Inventor: Anthony J. Sporri, Tallapoosa, Ga.

[73] Assignee: United States Can Company, Oak Brook, Ill.

[21] Appl. No.: 731,483

[22] Filed: Jul. 17, 1991

[51] Int. Cl.[5] ..... B67D 5/54

[52] U.S. Cl. ..... 222/389; 222/386

[58] Field of Search ..... 222/386, 386.5, 387, 222/389; 92/208, 237, 239, 240

[56] References Cited

U.S. PATENT DOCUMENTS

| | | | |
|---|---|---|---|
| 3,099,370 | 7/1963 | Hein | 222/386.5 |
| 3,132,570 | 5/1964 | Hoffman, Jr. et al. | 222/389 X |
| 3,245,591 | 4/1966 | Kneusel et al. | 222/389 |
| 3,827,607 | 8/1974 | Schultz | 222/389 |
| 3,901,410 | 8/1975 | Schultz . | |
| 3,901,416 | 8/1975 | Schultz | 222/389 |
| 3,920,165 | 11/1975 | Schultz . | |
| 4,023,717 | 5/1977 | Schultz | 222/389 X |
| 4,106,674 | 8/1978 | Schultz | 222/389 X |
| 4,234,108 | 11/1980 | Diamond | 222/386 |
| 4,703,875 | 11/1987 | Malek | 222/389 X |
| 4,913,323 | 4/1990 | Scheindel | 222/389 X |

*Primary Examiner*—Kevin P. Shaver

*Attorney, Agent, or Firm*—Leydig, Voit & Mayer

[57] ABSTRACT

An aerosol can piston and system, employing an aerosol can with a sidewall which is necked in at the bottom and a low mass piston with recessed, depending legs. The piston has a lower skirt portion, the outermost diameter of which is slightly smaller than the diameter of the inner wall of the can above the necked-in portion. The legs depending from the piston have an effective outer diameter somewhat less than the inside diameter of the lower necked-in portion of the can sidewall and depend sufficiently downward to sit on the can bottom countersink while maintaining the skirt of the piston at a level just above the level at which the can sidewall necks inwardly. The legs thus stabilize the piston and prevent tipping and canting. In an alternative embodiment the piston also includes a plurality of vertical columns protruding from its sidewall to further stabilize the piston.

9 Claims, 2 Drawing Sheets

LOW MASS PISTON SYSTEM FOR NECKED-IN AEROSOL CANS

BACKGROUND OF THE INVENTION

1. Field of the Invention

This invention relates to a piston and, more particularly, to a low mass piston adapted for use in pressurizing and expelling material from an aerosol container.

2. Description of Related Art

Low mass piston systems for use in aerosol containers in which the pressurizing gas is isolated from the material to be dispensed are well known. One application for which such systems are particularly well suited and in wide use is for post-foaming shaving gel products. Examples of such piston and can arrangements suitable for this and other applications are described in, for example, U.S. Pat. Nos. 4,703,875 and 4,913,323. Both of these patents describe pistons the largest outer diameter of which is slightly smaller than the inside diameter of the can such that a film of the material to be dispensed creates a seal between the piston and the can to prevent the pressurizing gas beneath the piston from bypassing the piston and mixing with the material to be dispensed. It will be appreciated that this arrangement, by calling for a typical film clearance of at least a few thousandths of an inch in the case of post-foaming shaving gel, results in a looseness of the piston in a can before either the material or the pressurizing gas are injected into the can. This looseness can result in a tipping or canting of the piston as the can is handled following assembly. This tendency to tip is enhanced in the case of stepped sidewall pistons of the types described in the two referenced patents. Such tipping, which causes a nonuniformity in the gap between the lower edge skirt of the piston and the sidewall of the can, can result in malfunctions in operation, including the escape of the pressurizing gas into the material to be dispensed.

Certain can configurations can aggravate the instability of the piston and its tendency to tip either before or during the filling operation. One such can configuration is one in which the cylindrical sidewall is necked in for the lower few millimeters of the can to enhance the appearance of the can. It has been found that the sloping transition zone in the can where the sidewall necks down to the smaller diameter, lower portion of the can, coupled with the flexibility of the lower edge of the piston, provides instability and allows considerable movement and tipping of the piston, which can lead to the problems noted above.

A primary object of the present invention is to provide a low mass piston system with improved piston stability, including when used in conjunction with necked in cans.

This and other objects will be apparent from the following summary of the invention and the detailed description of the preferred embodiment.

BRIEF SUMMARY OF THE INVENTION

One embodiment of the present invention employs a low mass piston having a sidewall which includes a lower skirt portion providing a relatively close clearance with the inner wall of the container and an upper sidewall portion providing a somewhat greater clearance. The upper portion of the piston is closed to create a typical inverted cup configuration. According to the invention, a series of circumferentially spaced recessed legs depend downwardly below the piston skirt at a radial position which permits them to seat on the bottom of the can inside of, and without significant contact with, the necked-in lower portion of the can sidewall. These legs are of such a length that they provide solid support for the piston while maintaining the lower edge of the piston skirt just above the level at which the sidewall of the can necks inwardly. This embodiment thus stabilizes the piston and prevents canting and tipping.

An alternative embodiment of the present invention also includes, along with a lower skirt and depending recessed legs, a generally vertical sidewall with a plurality of vertical columns comprising circumferentially spaced outwardly projecting protrusions running the length of the sidewall from the lower skirt up to the top portion. The effective diameter of the outermost surfaces of the columns is substantially the same as the largest diameter of the skirt, thus effectively creating circumferentially spaced vertical channels above the skirt and between the adjacent columns. The columns stabilize the piston and prevent it from tilting when the can is being filled or activated, and thus not only allow for a shorter piston (saving piston material), but also permit a greater amount of product to be filled into a given can size.

DETAILED DESCRIPTION OF THE INVENTION

Figure 1:
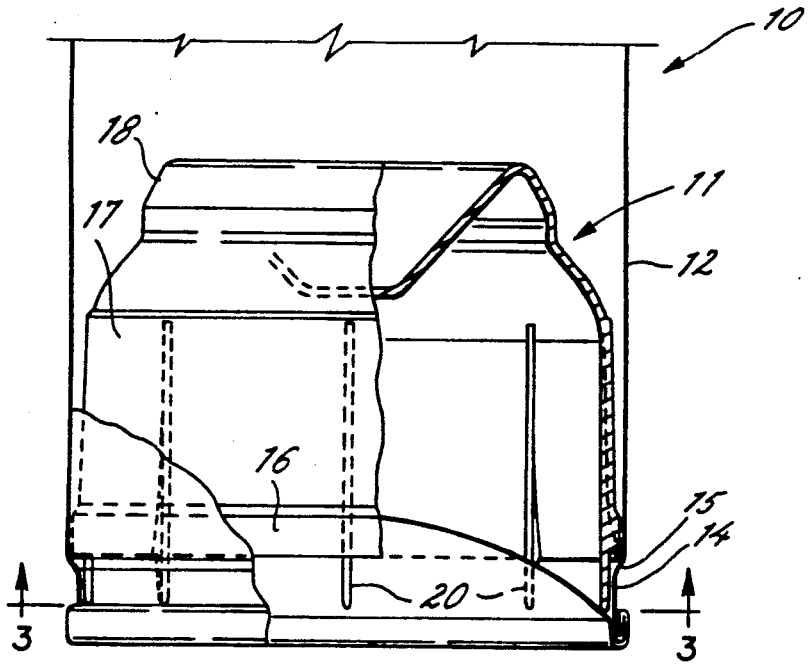
FIG. 1 is a partial sectional view of an aerosol can system according to the present invention.

While the invention is susceptible of various modifications and alternative constructions, illustrative embodiments have been shown in the drawings and will be described in detail below. It should be understood, however, that there is no intention to limit the invention to the specific forms described, but, on the contrary, the intention is to cover all modifications, alternatives and equivalents falling within the spirit and scope of the appended claims.

Turning now to the drawings, FIG. 1 illustrates an aerosol can system according to the present invention. This partial sectional view shows the lower portion of an aerosol can 10 in which a piston 11 isolates a lower chamber for pressurizing gas from an upper chamber for the product. The can shown has a sidewall 12 which necks in at the lower portion 14 thereof via a transition zone 15. The piston 11 has a sidewall which has a lower skirt portion 16 and a reduced diameter portion 17 extending from above the skirt to the top portion 18 of the piston. The top portion of the piston 18 is configured to complement and seat closely adjacent the top of the can (not shown) in order to expel the maximum amount of product as the piston reaches the end of its travel.

In the embodiment shown, the outside diameter of the skirt is sized slightly smaller than the inside diameter of the can in order to accommodate an annular film of product P to provide a lubricating seal between the piston and the can. It will be appreciated that the relative sizing of the piston and the can may be optimized for different applications. By way of example, a radial spacing of a few thousandths of an inch between the skirt and the interior surface of the can has been found suitable for use in an aerosol can system for dispensing post-foaming shaving gel. For the same application, a radial spacing of about 50 thousandths of an inch between the can wall and the upper portion 18 of the piston has been found suitable.

Figure 2:
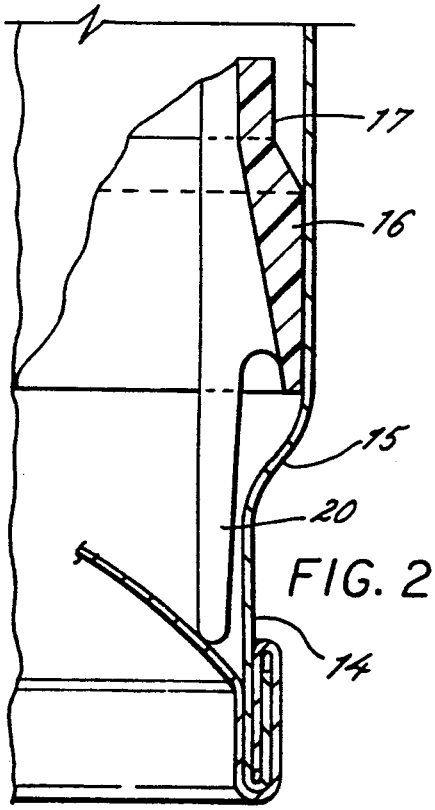
FIG. 2 is an enlarged partial sectional view of the lower portion of the aerosol can system of FIG. 1.

As shown best in the enlarged detail of FIG. 2, the lower portion 14 of the can sidewall is necked in to a diameter which would limit the travel of the piston below the transition wall 15. Absent a discreet ledge at the transition zone 15, however, the lower edge of the skirt 16 would not necessarily assume a stable position perpendicular to the axis of the can. Instead, tilting or canting could occur, leading to problems discussed above. In accordance with the present invention, the piston is provided with a series of circumferentially-spaced radially-recessed depending legs 20. While the number and spacing of the legs 20 may vary from application to application, in the embodiment shown there are eight equally-spaced legs. With the piston in its lowermost position in the can as shown in FIGS. 1 and 2, the legs 20 rest on the bottom countersink 21 at points near the outer periphery of the can bottom to stabilize the piston. As shown best in FIG. 2, the legs may be formed integrally with the interior wall of the piston as vertical struts which provide good strength. With such an arrangement the legs can be of relatively small cross section while deriving stiffness from the piston sidewall to provide adequate strength to resist any downward force exerted on the piston during the loading of product.

In the preferred embodiment, the effective outside diameter of the circumferentially spaced legs is somewhat smaller than the inside diameter of the lower portion of the can to avoid significant contact therebetween which might otherwise interfere with the seating of the legs on the can bottom. As a related consideration, inasmuch as can bottoms are typically upwardly convex (as shown in FIGS. 1 and 2) to resist internal pressures, the legs are preferably designed to rest on the can bottom countersink 21 in relatively close proximity to the annular seam between the lower sidewall and the bottom so that they effectively seat in the well-defined annular "V" formed between these two can components.

It will be appreciated that the configurations and cross sections of the legs 20 can be varied to achieve the derived stability with a variety of can designs, including the necked-in can illustrated.

Figure 3:
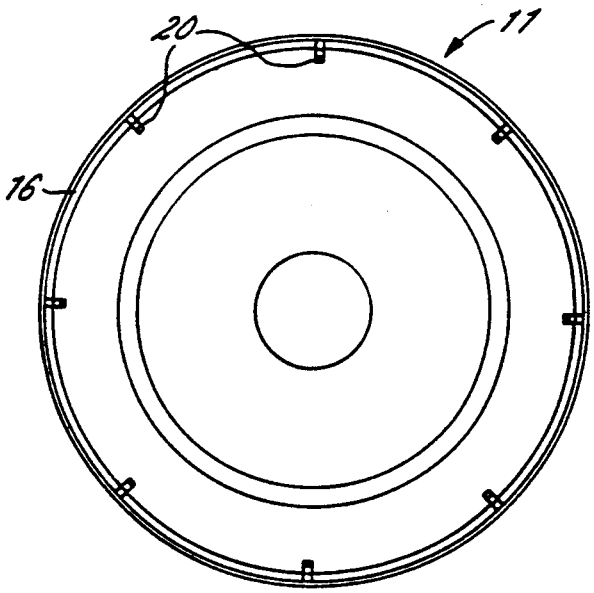
FIG. 3 is a bottom view of the aerosol can piston shown in FIGS. 1 and 2.
Figure 4:
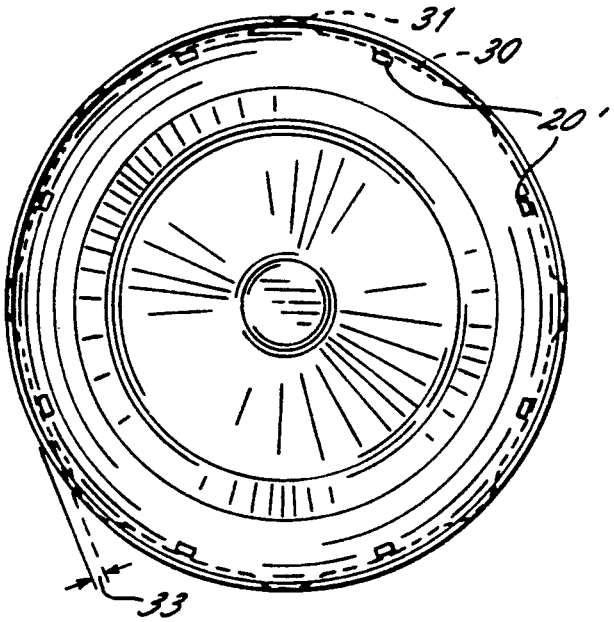
FIGS. 4–6 are top, side and bottom view, respectively, of an alternative embodiment of the invention.
Figure 5:
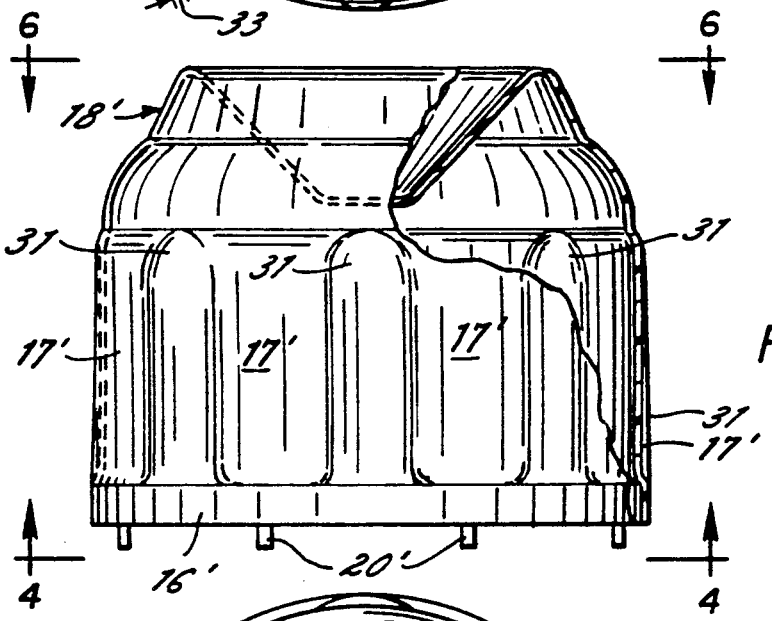
Figure 6:
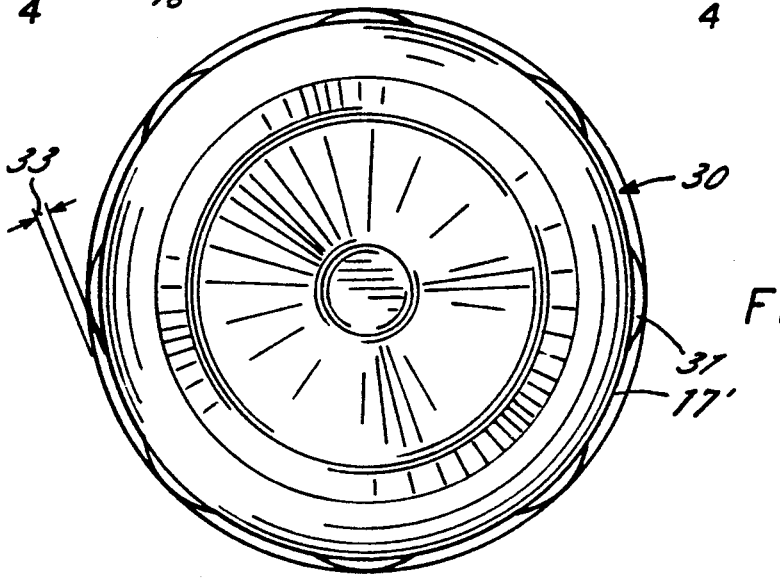

FIGS. 4–6 show an alternative embodiment of the invention. For convenience the elements in this alternative embodiment which correspond to similar elements in the FIG. 1–3 embodiment have been assigned the same item numbers with a prime designation (e.g. 21' in the FIG. 4–6 embodiment corresponds to item 21 in the FIG. 1–3 embodiment).

As shown in FIGS. 4–6, the alternative embodiment is similar to the FIG. 1–3 embodiment except for the inclusion of a number of protruding vertical columns 31. The effective diameter of the outermost surfaces of each of the columns is substantially the same as the largest diameter of the skirt, thus creating multiple vertical channels bounded by the lower skirt 16' at the bottom and by the vertical columns 31 on the sides. The channels are open at the top to allow product to initially flow into the channels when the can is filled to provide increased stabilization. The columns themselves also provide additional stabilization for the piston and prevent canting and thereby allow for the effective use of a shorter piston. Use of a shorter piston results in material savings in the piston and can materials because the same quantity of product can be placed into a shorter can with a shorter piston. Conversely, a greater quantity of product can be placed into a given can size. It will be appreciated that, as with the FIG. 1–3 embodiment, the spacing between the can wall and the non-protruding piston wall 17', is adaptable to various viscosities of product to be dispensed, to achieve optimum flow into the sealing area of the piston. Finally, in accordance with the invention, and as with the embodiment shown in FIG. 1–3, the FIG. 4–6 embodiment includes a series of recessed depending legs 20 which rest on the can bottom countersink 21 to stabilize the piston, especially in the case of necked-in cans.

I claim:

1. An aerosol can system comprising a can comprising a generally cylindrical sidewall and top and bottom elements, the lower portion of the sidewall being necked in to a diameter smaller than that of the upper portion of the sidewall;

a piston disposed within the can, the piston comprising a generally cylindrical sidewall with a lower edge, a top portion, and projections recessed radially relative to the lower edge and depending below the lower edge of the piston sidewall, the effective outer diameter of the projections being somewhat less than the inside diameter of the lower portion of the piston sidewall whereby the projections set on the can bottom countersink to stabilize the piston when the piston is in its lowermost position.

2. A piston for use with an aerosol can having a generally cylindrical sidewall and top and bottom elements, the lower portion of the sidewall being necked into a diameter smaller than that of the upper portion of the sidewall, the piston comprising a generally cylindrical sidewall with a lower edge, a top portion, and projections recessed radially relative to the lower edge and depending below the lower edge of the piston sidewall, the effective outer diameter of the projections being somewhat less than the inside diameter of the lower portion of the piston sidewall whereby the projections set on the can bottom countersink to stabilize the piston when the piston is in its lowermost position.

3. The piston of claim 2 wherein the projections are a series of circumferentially spaced depending legs.

4. The piston of claim 3 wherein the legs are integrally formed with the interior of the piston sidewall.

5. The piston of claim 2 wherein the piston is injection molded of plastic material.

6. A piston for use with an aerosol can having a generally cylindrical sidewall and top and bottom elements, the lower portion of the sidewall being necked into a diameter smaller than that of the upper portion of the sidewall, the piston comprising a generally vertical sidewall with a lower edge, a top portion and projections recessed radially relative to the lower edge and depending below the lower edge of the piston sidewall, the effective outer diameter of the projections being somewhat less than the inside diameter of the lower portion of the piston sidewall whereby the projections set on the can bottom countersink to stabilize the piston when the piston is in its lowermost position, said piston sidewall comprising a lower skirt slightly smaller in diameter than the inside diameter of the sidewall of the can, and an upper sidewall portion smaller in diameter than the lower skirt portion, said upper sidewall portion including a plurality of vertical columns, said columns comprising circumferentially spaced, outwardly projecting vertical protrusions, the effective diameter of the outermost surfaces of the columns being substantially the same as the largest diameter of the lower skirt, thus forming a plurality of vertical, circumferentially spaced channels between said piston sidewall and said can sidewall into which channels product can initially flow to further stabilize said piston within said can.

7. The piston of claim 6 wherein the recessed projections are a plurality of circumferentially spaced, depending legs, one such depending leg spaced substantially equidistantly between each protrusion.

8. The piston of claim 6 wherein said vertical protrusions are integrally molded with the piston wall.

9. The piston of claim 6 wherein the piston is injection molded of plastic material.

* * * * *